US007172398B2

(12) United States Patent
Bentley et al.

(10) Patent No.: US 7,172,398 B2
(45) Date of Patent: Feb. 6, 2007

(54) STABILIZED FILAMENT DRAWING DEVICE FOR A MELTSPINNING APPARATUS AND MELTSPINNING APPARATUS INCLUDING SUCH STABILIZED FILAMENT DRAWING DEVICES

(75) Inventors: Rachelle Bentley, Cumming, GA (US); Patrick L. Crane, Dawsonville, GA (US); Matthew Duane Thompson, Cumming, GA (US)

(73) Assignee: Aktiengesellschaft Adolph Saurer (DE)

( * ) Notice: Subject to any disclaimer, the term of this patent is extended or adjusted under 35 U.S.C. 154(b) by 0 days.

(21) Appl. No.: 11/278,279

(22) Filed: Mar. 31, 2006

(65) Prior Publication Data

US 2006/0172024 A1 Aug. 3, 2006

Related U.S. Application Data

(63) Continuation-in-part of application No. 10/714,778, filed on Nov. 17, 2003.

(51) Int. Cl.
*B28B 5/00* (2006.01)

(52) U.S. Cl. ..... 425/72.2; 264/211.14

(58) Field of Classification Search ..... 425/72.2; 264/211.14

See application file for complete search history.

(56) References Cited

U.S. PATENT DOCUMENTS

| | | | | |
|---|---|---|---|---|
| 2,052,869 A | | 9/1936 | Coanda | |
| 3,274,644 A | * | 9/1966 | Moore et al. | 425/72.2 |
| 3,485,428 A | | 12/1969 | Jackson | |
| 3,692,618 A | | 9/1972 | Dorschner et al. | |
| 3,981,650 A | * | 9/1976 | Page | 425/72.2 |
| 4,014,487 A | | 3/1977 | Reba et al. | |
| 4,159,200 A | * | 6/1979 | Shono et al. | 65/496 |
| 4,285,452 A | | 8/1981 | Reba et al. | |
| 4,472,886 A | | 9/1984 | Reba | |
| 5,045,271 A | | 9/1991 | Mente et al. | |
| 5,162,074 A | | 11/1992 | Hills | |
| 5,225,018 A | | 7/1993 | Zeldin et al. | |
| 5,312,500 A | | 5/1994 | Kurihara et al. | |
| 5,397,413 A | | 3/1995 | Trimble et al. | |
| 5,807,795 A | | 9/1998 | Lau et al. | |
| 5,993,943 A | | 11/1999 | Bodaghi et al. | |
| 6,182,732 B1 | | 2/2001 | Allen | |

(Continued)

FOREIGN PATENT DOCUMENTS

WO 02 052071 A2 7/2002

(Continued)

*Primary Examiner*—Joseph S. Del Sole
(74) *Attorney, Agent, or Firm*—Moore & Van Allen PLLC

(57) ABSTRACT

A stabilized filament drawing device for a meltspinning apparatus and a meltspinning apparatus including the stabilized filament drawing device. The stabilized filament drawing device applies a high-velocity flow of air to attenuate the filaments, which are discharged from a device outlet in a discharge direction. The filament drawing device includes multiple inclined guides adjacent to the outlet that cause the filaments and high-velocity flow of air to deviate from the discharge direction. Each of the guides has a major surface that is angled relative to a common plane containing the discharge direction and a cross-machine direction of the device outlet of the filament drawing device. The guides are oriented such that the major surface is also inclined relative to the discharge direction.

10 Claims, 5 Drawing Sheets

U.S. PATENT DOCUMENTS 6,244,845 B1 * 6/2001 Milligan et al. ..... 425/7
6,247,911 B1 * 6/2001 Milligan ..... 425/7
6,338,814 B1 1/2002 Hills
6,499,982 B2 12/2002 Allen et al.
6,511,566 B1 1/2003 Wessel et al.
6,524,521 B1 2/2003 Kuroiwa et al.
6,709,623 B2 * 3/2004 Haynes et al. ..... 264/465
6,799,957 B2 10/2004 Allen
6,989,125 B2 * 1/2006 Boney et al. ..... 264/465

FOREIGN PATENT DOCUMENTS

WO 2004 048664 A2 6/2004

* cited by examiner

STABILIZED FILAMENT DRAWING DEVICE FOR A MELTSPINNING APPARATUS AND MELTSPINNING APPARATUS INCLUDING SUCH STABILIZED FILAMENT DRAWING DEVICES

CROSS-REFERENCE TO RELATED APPLICATIONS

This application is a continuation-in-part of application Ser. No. 10/714,778, filed Nov. 17, 2003, the disclosure of which is hereby fully incorporated by reference herein.

FIELD OF THE INVENTION

The invention relates generally to apparatus for forming spunbond nonwoven webs and, more particularly, to apparatus and methods for stabilizing the paths of airborne filaments in meltspinning devices.

BACKGROUND OF THE INVENTION

Nonwoven webs and their manufacture from melt-processable thermoplastic polymers has been the subject of extensive development resulting in a wide variety of materials for numerous commercial applications. Nonwoven webs formed from a spunbond process consist of a sheet of overlapped and entangled filaments or fibers of melt-processable thermoplastic polymers. A spunbond process generally involves extruding a dense curtain of semi-solid filaments from a spinneret of a spin pack. The descending curtain of filaments is cooled by a cross flow of cooling air and the individual filaments are attenuated or drawn by a filament drawing device or aspirator. Spunbond filaments are generally continuous in a lengthwise direction and have average diameters in the range of about 10 to 20 microns. Filaments discharged from the drawing device are collected as a sheet of entangled loops on a collector, such as a forming belt or a forming drum, and are deposited as a continuous length nonwoven web.

Various different types of conventional drawing devices are available for use in meltspinning apparatus. Generally, a drawing device receives the curtain of filaments descending from the spinneret in a slotted passageway and directs a high-velocity stream of process air at the filaments from one or more venturis or air jets exhausting into the passageway. Each air stream is oriented substantially tangential to the filament length and exerts a drawing force on the filaments that increases the filament velocity. The drawing force attenuates the filaments in the space between the spinneret and the drawing device inlet and in the space between the drawing device and the collector. In addition, the polymer chains constituting the filaments may be oriented if the filament velocity or spinning speed is sufficiently high.

Certain characteristics of the high-velocity stream of process air used to attenuate the filaments are believed to degrade the quality of the collected nonwoven web. In one aspect, the high-velocity stream of process air exiting the venturis creates lateral vortices that travel down the confronting planar surfaces defining the slotted passageway and eventually exit the passageway outlet along with the filaments and high-velocity process air. The interaction of the lateral vortices with the descending filaments and the high-velocity of the stream of process air causes unpredictable variations in the looping of the filaments. As a result, localized areas of relatively low web density and relatively high web density result that reduces the long range uniformity of the collected nonwoven web. This loss of uniformity may be undesirable for those end products intended to be fluid impervious because the low-density areas may provide leakage paths through the material.

The high-velocity process air aspirates secondary air from the environment adjacent the outlet. The secondary air mixes with the process air and filaments at the end and side boundaries of the outlet from the drawing device. The mixing causes the airborne filaments to oscillate in a chaotic and random manner in the flight path from the outlet of the drawing device to the collection device. The randomized movement of the airborne filaments decreases the integrity of the nonwoven web due to variations in coverage. The aspirated secondary air at the end boundaries of the outlet also produces inwardly-directed currents of secondary air that cause filaments exiting adjacent to the end boundaries to move inwardly as they travel toward the collection device. This inward movement may increase the local filament density adjacent to the end boundaries. As a result, the opposite peripheral margins of the nonwoven web have an increased basis weight.

A conventional technique for decreasing the randomness and chaotic character of the paths traced by filaments during their descent to the collector is to provide the drawing device with rows of thin fingers or guide fins upstream of the outlet. Conventional guide fins are formed of bent strips of thin sheet metal arranged into two rows extending in the cross-machine direction. The two rows are separated by an open space or tunnel. Guide fins in the upstream row are inclined and those in the downstream row are oriented vertically. Adjacent pairs of guide fins in each row are separated by a small gap. The guide fins in the downstream row are arranged to be offset by one-half of the row pitch from the guide fins in the upstream row so that the upstream row is not covered.

The rows of guide fins fail to prevent the difficulties associated with the mixing of aspirated secondary air and the high-velocity process air exiting the drawing device and introduce additional artifacts into the structure of the nonwoven web. Secondary air is aspirated through the gaps between adjacent guide fins in each row and flows through the space between the two rows. The aspirated air flowing through the gaps between the guide fins toward the filaments causes filaments being guided by the upstream row to shift laterally (i.e., in the cross-machine direction) so that the resultant nonwoven web has alternating low-density and high-density stripes spaced across the width of the web with the periodicity of the guide fin pitch. The striping reduces the integrity of the nonwoven web and causes undesirable formation variations.

Raising the drawing device away from the collection device reduces the striping and increases filament entanglement and web integrity. However, as the distance is increased between the drawing device outlet and the collection device, chaotic movement of the filaments increases the loop size of the collected filaments and bundling or twisting. Web quality is reduced by the occurrence of random localized areas of relatively low web density and areas of relatively high web density.

Conventional guide fins cannot eliminate the lateral vortices from the high-velocity air exiting the drawing device. The inability to eliminate the lateral vortices further increases the randomness of, and lack of control over, the trajectories of the descending filaments. These conventional guide fins are formed from bent sheet metal, which lacks robustness. As a result, the guide fins may be easily bent out of position by accidental contact.

One approach for increasing production in a spunbond process is to increase the line speed of the collector and the flow of the melt-processable thermoplastic polymer through the spinneret. However, increasing the line speeds may also increase the problems associated with controlling the properties of the resulting nonwoven web mentioned above. In particular, increased line speeds result in filament formation that is preferentially oriented in the machine direction, as opposed to the cross-machine direction. The consequence is that, although the preferential orientation increases the web strength in the machine direction, web strength is effectively lost in the cross-machine direction.

Devices have been developed that provide satisfactory improvements in the stability and guide of the airborne filaments. Such devices are shown in commonly-assigned U.S. application Ser. No. 10/714,778. A need exists, however, to further improve the stability and the guidance of airborne filaments descending from the drawing device to the collector.

SUMMARY

A drawing device is provided for attenuating a plurality of filaments in a meltspinning apparatus. The drawing device includes a manifold with an inlet for receiving the filaments, an outlet oriented in a cross-machine direction, and a passageway between the inlet and the outlet. The manifold has a slotted channel communicating with the passageway for discharging air to impinge the filaments in the passageway and the manifold discharging the filaments and the air from the outlet in a downward direction perpendicular to the cross-machine direction. A plurality of first guides are positioned proximate to the outlet. Each of the first guides includes a first major surface oriented at a first rotational angle relative to the cross-machine direction. A plurality of second guides positioned proximate to the outlet. Each of the second guides is positioned between a corresponding adjacent pair of the first guides. Each of the second guides includes a second major surface oriented at a second rotational angle relative to the to the cross-machine direction. The first and second inclined surfaces are inclined with different inclination angles relative to the downward direction so as to cause the flow of air and the filaments to deviate from the second direction.

In another embodiment, the drawing device may be a component of a meltspinning apparatus for depositing filaments on a collector to form a nonwoven web. The meltspinning apparatus further comprises a spin pack capable of forming the filaments from a thermoplastic material.

In accordance with the principles of the invention, the guides of the drawing device separate the descending sheet or curtain of airborne filaments into two distinct sheets or curtains that are spaced apart in the machine direction. The individual guides of the stabilizing device promote a barrier action that counteracts the vortices and, thereby, prevents the propagation of the vortices from the drawing device outlet to the collection device. This reduces the randomness of the filament trajectories by eliminating or, at the least, significantly reducing turbulence. The rotation of the inclined surfaces of the guides relative to the machine direction is believed to enhance entanglement of the deposited filaments constituting the nonwoven web.

The individual guides channel the high-velocity process air into discrete, aerodynamic columns that remain substantially undisturbed and intact between the drawing device outlet and the collection device. The guides also dissipate filament energy, which slows the filament velocity. Because of these beneficial effects, filament looping is more controlled and compact, which increases filament entanglement and thereby enhances web integrity by providing a greater degree of filament interlocking. Because the two rows of guides are not separated by open areas, ambient air cannot be aspirated between the individual guides, which prevents or, at the least, lessens filament twisting and bundling. The elimination of open areas also permits the drawing device outlet to be placed closer to the collection device during operation without inducing web striping. The guides also eliminate, or at least reduce, the inward movement of airborne filaments proximate the side edges of the drawing device outlet.

The drawing devices of the invention may also be used to add directionality to the strength of the nonwoven web. Specifically, the guides may be configured to provide the nonwoven web with a substantially isotropic strength by tailoring the filament loops to provide a machine direction to cross-machine direction (MD/CD) strength ratio of about 1:1 to 2:1. Alternatively, the guides may be configured to provide a highly anisotropic web that is stronger in the machine direction than in the cross-machine direction by adjusting the MD/CD strength ratio to be in the range of greater than or equal to about 2:1 and less than or equal to about 10:1. One approach for tailoring the MD/CD strength ratio is to adjust the configuration of the guides to vary filament elongation in the machine direction. Another approach for tailoring the MD/CD strength ratio is to vary the separation between the drawing device outlet and the collection device to intentionally produce stripes of relatively low web density separating stripes of relatively high web density.

In accordance with the principles of the invention, the filaments may be drawn to a smaller diameter using significantly less air flow in the drawing device. The savings in process air consumption translates to significant customer savings, reductions in capital equipment costs as the air handling capacity of blowers serving the filament drawing device may be reduced, and reduced consumable costs.

The features and objectives of the present invention will become more readily apparent from the following Detailed Description taken in conjunction with the accompanying drawings.

BRIEF DESCRIPTION OF THE FIGURES

The accompanying drawings, which are incorporated in and constitute a part of this specification, illustrate embodiments of the invention and, together with a general description of the invention given above, and the detailed description given below, serve to explain the principles of the invention.

DETAILED DESCRIPTION OF THE PREFERRED EMBODIMENTS

The invention is directed to apparatus and method for controlling the flight of spunbond filaments in the space between the slotted outlet of a drawing device and a collection device. To that end, a drawing device includes multiple guides that interact with the high-velocity air flow and entrained filaments to influence filament laydown on the collection device. Although the invention will be described herein as being associated with an exemplary meltspinning system, it should be understood that modifications to the exemplary meltspinning system described herein could be made without departing from the intended spirit and scope of the invention.

Figure 1:
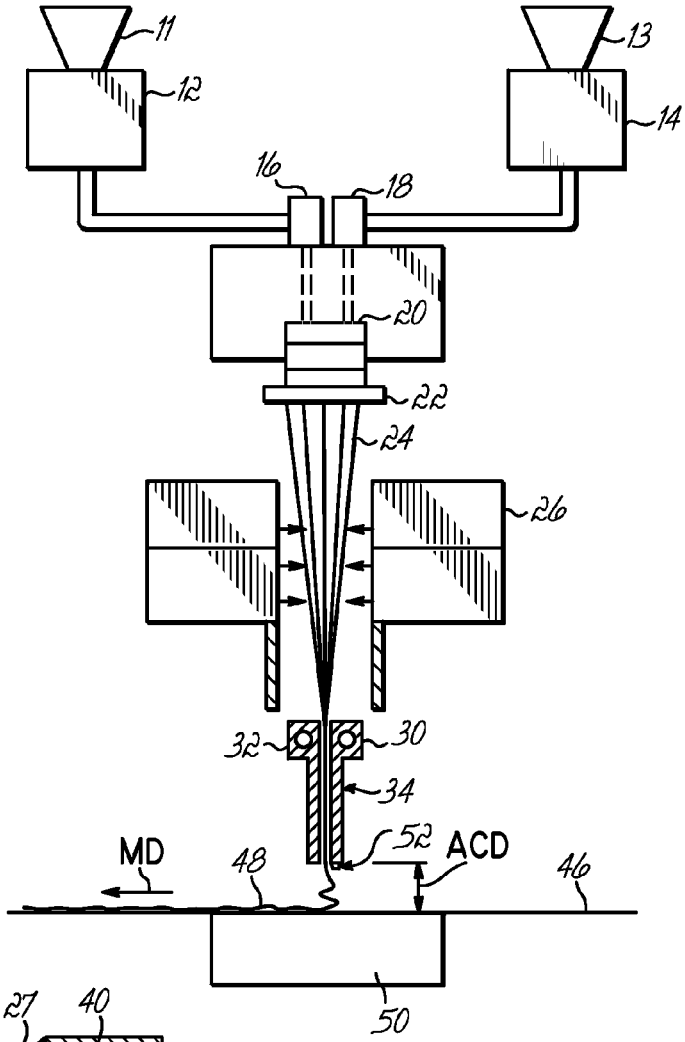
FIG. 1 is a side view of a meltspinning apparatus in partial cross-section for forming a nonwoven web in accordance with the principles of the invention.

With reference to FIG. 1, a spunbonding apparatus 10 is equipped with a pair of screw extruders 12, 14 that each convert a solid melt-processable thermoplastic polymer into a molten state and transfer the molten thermoplastic polymers under pressure to a corresponding set of metering pumps 16, 18. Pellets of thermoplastic polymers are placed in hoppers 11, 13 and fed to the corresponding one of screw extruders 12, 14. Each of the sets of metering pumps 16, 18 pump metered amounts of the corresponding thermoplastic polymers to a spin pack 20, which combines the thermoplastic polymers. Spin packs are familiar to persons of ordinary skill in the art and, therefore, are not described here in detail. Generally, spin pack 20 includes flow passageways arranged to separately direct the thermoplastic polymers to a spinneret 22. The spinneret 22 includes rows of spinning orifices (not shown) from which a dense curtain of filaments 24 each constituted collectively by the two thermoplastic polymers is discharged. As will be understood in accordance with the principles of the invention, the spunbonding apparatus 10 may combine more than two different thermoplastic polymers to form multicomponent filaments 24, may combine two identical polymers to form monocomponent filaments 24, or may include a single extruder for forming monocomponent filaments 24. An exemplary spin pack 20 is disclosed in U.S. Pat. No. 5,162,074, the disclosure of which is hereby incorporated by reference herein in its entirety.

The filaments 24 may be fabricated from thermoplastic polymer(s) selected from among any commercially available spunbond grade of a wide range of thermoplastic polymer resins, copolymers, and blends of thermoplastic polymer resins, including, without limitation, polyolefins, such as polyethylene and polypropylene, polyesters, nylons, polyamides, polyvinyl acetate, polyvinyl chloride, polyvinyl alcohol, and cellulose acetate. Additives such as surfactants, colorants, anti-static agents, lubricants, flame retardants, antibacterial agents, softeners, ultraviolet absorbers, polymer stabilizers, and the like may also be blended with the thermoplastic polymer provided to the spin pack 20. The invention contemplates that each constituent thermoplastic polymer in the filaments 24 may be identical in base composition and differ only in additive concentration. The shape of the spinning orifices in spinneret 22 can be chosen to accommodate the cross-section desired for the extruded filaments.

The descending curtain of filaments 24 is quenched with a cross flow of cooling air from a quench blower 26 to accelerate solidification. The filaments 24 are drawn into a flared inlet or throat 27 of an elongated slot 28 defined between an upstream manifold 30 and a downstream manifold 32 of a drawjet or filament drawing device 34. Process air supplied from a blower (not shown) is directed through supply passageways 36, 38 inside the upstream and downstream manifolds 30, 32, respectively. Typically, the process air is supplied at a pressure of about 5 pounds per square inch (psi) to about 100 psi, typically within the range of about 30 psi to about 60 psi, and at a temperature of about 60° F. to about 85° F.

The air supply passages 36, 38 are each coupled with the slot 28 through a corresponding one of a pair of slotted channels 40, 42. Each of the slotted channels 40, 42 tapers or narrows in a direction from the corresponding one of the air supply passages 36, 38 to the slot 28 for increasing the air velocity by the venturi effect. High-velocity sheets of process air are exhausted continuously from the slotted channels 40, 42 along the opposite sides of the slot 28 in a downwardly direction generally parallel to the length of the filaments 24. Because the filaments 24 are extensible, the converging, downwardly-directed sheets of high-velocity process air attenuate and molecularly orient the filaments 24. Exemplary air flow arrangements for filament drawing devices are disclosed in U.S. patent application Ser. No. 10/072,550 and U.S. Pat. No. 6,182,732, the disclosures of which are hereby incorporated herein by reference in their entirety.

The filaments 24 are discharged from an outlet 44 of slot 28 and are propelled toward a formaminous or porous collector 46, such as a moving screen belt. The airborne filaments 24 descend toward the collector 46 with oscillatory or spiraling trajectories that increase in amplitude in the cross-machine direction with increasing distance from the outlet 44. The oscillatory trajectories are exaggerated in FIG. 1 for clarity. The filaments 24 deposit in a substantially random manner as substantially flat loops on the collector 46 to collectively form a nonwoven web 48. The collector 46 moves in a machine direction, represented by the arrow labeled MD, parallel to the continuous length of the nonwoven web 48. The width of the nonwoven web 48 deposited on collector 46 in a cross-machine direction, which is perpendicular to the machine direction and into and out of the plane of the page of FIG. 1, is substantially equal to the width of the curtain of filaments 24.

An air management system 50 positioned below the collector 46 and underneath the outlet 44 supplies a vacuum that is transferred through the collector 46 for attracting the filaments 24 onto a surface of the collector 46. The air management system 50 efficiently and effectively disposes of the high-velocity process air from the filament drawing device 34 so that filament laydown is relatively undisturbed. Exemplary air management systems 50 are disclosed in U.S. Pat. No. 6,499,982, the disclosure of which is hereby incorporated by reference herein in its entirety.

Additional spunbonding apparatus, not shown but similar to spunbonding apparatus 10, and meltblowing apparatus (not shown) may be provided downstream of spunbonding apparatus 10 for depositing one or more spunbond and/or meltblown nonwoven webs of either monocomponent or multicomponent filaments 24 on nonwoven web 48. An example of such a multilayer laminate in which some of the individual layers are spunbond and some meltblown is a spunbond/meltblown/spunbond (SMS) laminate made by sequentially depositing onto a moving forming belt first a spunbond nonwoven web, then a meltblown nonwoven web and last another spunbond nonwoven web.

References herein to terms such as "vertical", "horizontal", etc. are made by way of example, and not by way of limitation, to establish a frame of reference. In the frame of reference, downstream and upstream directions, locations and positions are specified with regard to the machine direction in which the web is moving downstream. It is understood various other frames of reference may be employed without departing from the spirit and scope of the invention.

Figure 2:
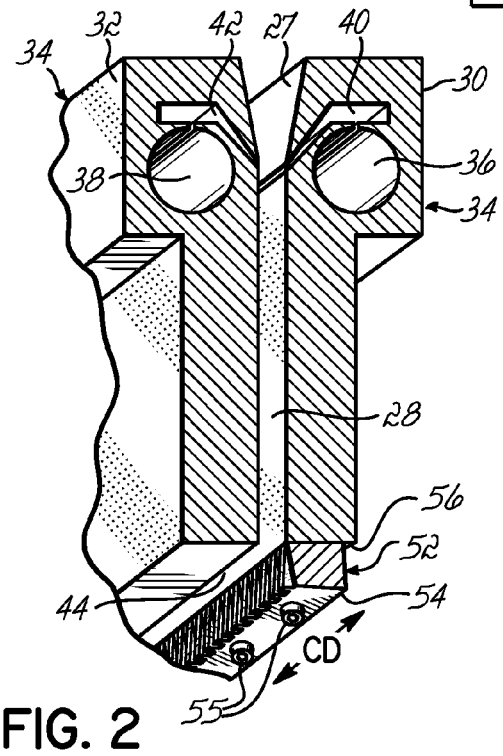
FIG. 2 is a perspective view of a portion of FIG. 1.
Figure 3:
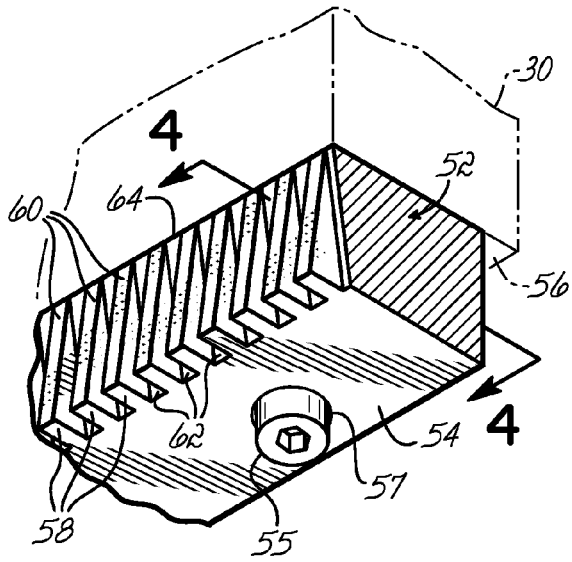
FIG. 3 is a bottom perspective view of a portion of the drawing device of FIG. 1.

With continued reference to FIGS. 1–3 and in accordance with the principles of the invention, the upstream manifold 30 of the filament drawing device 34 features a diffuser or stabilizer 52. The stabilizer 52 is effective to cause the sheet of air and filaments 24 discharged from the slot 28 to experience an unbalanced and directional flow. The stabilizer 52 includes an elongated body 54 that extends across the width of the upstream manifold 30 in a cross-machine direction, represented by the arrow labeled CD. Body 54 projects downwardly from a lower surface 56 of the upstream manifold 30 and generally toward the collector 46 so that the upstream manifold 30 has a greater effective vertical dimension than the downstream manifold 32. Body 54 includes bolt holes 57 that receive conventional fasteners 55 (FIG. 2) for mounting the stabilizer 52 to the filament drawing device 34. The lower surface 56 of the upstream manifold is spaced from the collector 46 by a separation labeled as ACD in FIG. 1.

Figure 4:
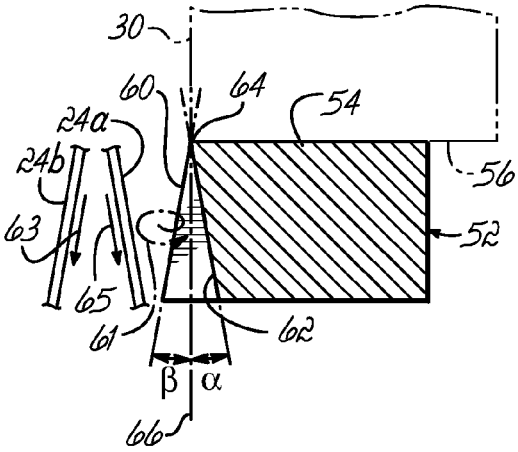
FIG. 4 is a cross-sectional view taken generally along line 4—4 of FIG. 3.

With reference to FIGS. 2–4, the body 54 includes a plurality of substantially-parallel bosses 58 of triangular transverse cross-section viewed parallel to the cross-machine direction. Each of the bosses 58 defines one of a corresponding plurality of first guides 60, which are arranged in a row extending in the cross-machine direction. Defined in the uniform-width recesses between adjacent pairs of bosses 58 is a plurality of second guides 62, likewise arranged in a row extending in the cross-machine direction. The first and second guides 60, 62 diverge from an edge 64 extending parallel to the cross-machine direction toward the collector 46 and are located upstream of outlet 44 from a downstream perspective. Guides 60 alternate or are interleaved with guides 62 in the cross-machine direction. Bosses 58 introduce discontinuities that disrupt or interrupt the cross flow of aspirated air in the cross-machine direction along the guides 60, 62. In addition, any vortices 61 (FIG. 4) representing circular airflow will be disrupted by the presence of the bosses 58, which eliminates flow of aspirated air in the cross-machine direction. No open spaces are present between the rows of guides 60, 62.

Each of the first and second guides 60, 62 represents a surface that is angled relative to a plane 66, which is positioned with a bisecting relationship between the row of first guides 60 and the row of second guides 62. Plane 66 may extend parallel to a vertical plane extending through the midline of the slot 28. Each of the guides 62 is angled relative to plane 66 with a negative inclination or declination angle $\alpha$ in an upstream direction and each of the guides 60 is angled relative to plane 66 with a positive inclination or declination angle $\beta$ in a downstream direction. Typically, the declination angles of the guides 60, 62 are equal and opposite about plane 66 so that the set of guides 60 has planar symmetry with the set of guides 62, although the invention is not so limited. Adjacent pairs of guides 60 and adjacent pairs of guides 62 each have a uniform center-to-center spacing and width in the cross-machine direction, although the invention is not so limited. Each set of guides 60, 62 may have a repeating pattern, as depicted in FIGS. 2–4 or a non-repeating pattern. As an example of a non-repeating pattern, one or both sets of guides 60, 62 may have a declination angle that varies with location in the cross-machine direction, such as an increasing declination extending in both transverse directions relative to the center of body 54 so that guides 60, 62 near the center of body 54 have a smaller declination angle than guides 60, 62 at the transverse edges of body 54.

The guides 62 have a non-overlapping relationship with guides 60 so that, when viewed from the perspective of a downstream location, each of the surfaces 60, 62 is fully visible to the filaments 24. As a result, each of guides 60 has a non-overlapping relationship with the adjacent pair of upstream guides 62 and, similarly, each of guides 62 has a non-overlapping relationship with the adjacent pair of downstream guides 60. The high-velocity sheet of air discharged from outlet 44 of slot 28 has an inherent tendency to aspirate or entrain secondary air from the surrounding environment. The stabilizer 52 blocks aspiration of secondary air in an upstream to downstream direction from the air space beneath the upstream manifold 30, as no spaces are present between adjacent guides 60, 62.

With reference to FIG. 4, the guides 60, 62 partition the sheet of air into a plurality of columnar air streams represented diagrammatically by arrows 63 and 65. Each individual columnar air stream 63, 65 is guided or steered by one of the guides 60, 62. Specifically, guides 60 deflect the columnar air streams 63 in an upstream direction due to the declination of each individual guide 62 in an upstream direction. Filaments 24*b* represent a portion of filaments 24 guided downstream or in the machine direction by guides 60. Filaments 24*a*, which are entrained in columnar air streams 65 deflected by guides 62, represent a portion of filaments 24 that are deflected in the upstream direction or counter to the machine direction. The travel path of the filaments 24 follows the deflected columnar air streams 63, 65. The deflection of the filaments 24 and entraining air is believed to arise from a phenomenon known as the Coanda effect. The term "deflect" is used consistently with its common dictionary definition of to turn aside especially from a straight course or fixed direction. In this instance, the filaments 24*a,b* are deflected relative to their discharge direction when exiting the outlet 44 of the filament drawing device 34.

The effect of the guides 60, 62 is to split the descending curtain of filaments 24 into two separate descending curtains, namely, a first descending curtain of filaments 24*a* deflected in an upstream direction and a second descending curtain of filaments 24*b* deflected in a downstream direction. The deflection is accomplished without contact occurring between the filaments 24 and guides 60, 62. The presence of two distinct curtains of filaments 24*a* and 24*b* increases web uniformity and integrity of the collected nonwoven web 48 (FIG. 1). The disruption of the circulation of vortices 61, as mentioned above, also contributes to increasing web uniformity and integrity by reducing or eliminating localized areas of relatively low web density and relatively high web density.

With reference to FIGS. 2–4, the characteristics of the guides 60, 62 influence the characteristics of filament deflection and subsequent laydown on the collector 46. The characteristics of the guides 60, 62 that define the columnar air streams 63, 65 reduce the randomness in the movement of the filaments during descent and, thereby, control the filament looping so that the loops are more compact for a given ACD (FIG. 1) than observed for conventional guiding schemes. For typical airflow rates from the filament drawing device 34, the vertical dimension or length of each of the guides 60, 62 is on the order of 0.5 inch to about 3.0 inches. The center-to-center spacing between adjacent guides 60 and adjacent guides 62 may vary between about 0.2" to about 0.75". Each of the guides 60, 62 is tilted or angled relative to the vertical plane 66 between about 3° and about 30°, preferably about 10°. The guides 60 and guides 62 may have equal declination angles or the declination angles may vary either in a periodic manner or irregularly in the cross-machine direction. For example, the declination angle of each independent set of guides 60, 62 or both sets of guides 60, 62 may have a non-repeating pattern that decreases with increasing distance from the cross-machine midpoint of the body 54.

Figure 5A:
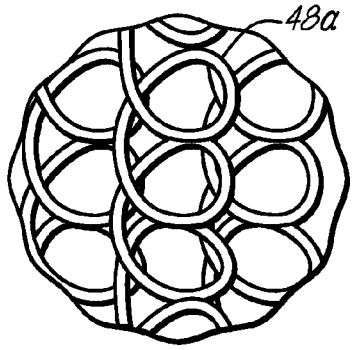
FIGS. 5A and 5B are diagrammatic views of a portion of a nonwoven web in accordance with the principles of the invention.
Figure 5B:
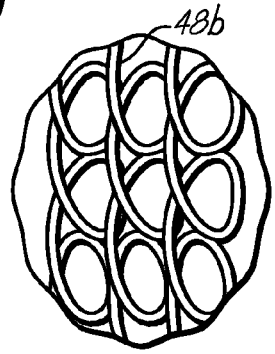
Figure 4A:
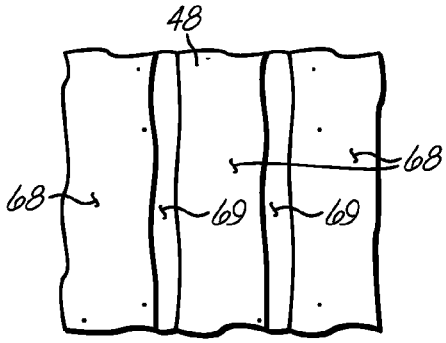
FIG. 4A is a diagrammatic top view of a portion of nonwoven web produced in accordance with the principles of the invention.

With reference to FIGS. 5A and 5B, the characteristics of the guides 60, 62 may be selected to modify to vary the shape of the filament loops on the collector 46. With reference to FIG. 5A, the guides 60, 62 may be configured so that the filament loops 48*a* are nearly circular and non-directional, which produces an isotropic MD/CD strength ratio in the range of about 1:1 to 2:1. With reference to FIG. 5B, the guides 60, 62 may be configured such that filament loops 48*b* of nonwoven web 48 deposit on collector 46 with significant elongation in the machine direction. This supplies an anisotropic MD/CD strength ratio of about 2:1 to 10:1, depending upon the extent of the elongation.

Alternatively and with reference to FIGS. 1–4 and 4A, the spunbonding apparatus 10 may also be configured for tailoring the strength of the nonwoven web 48. Specifically, the ACD may be adjusted to intentionally introduce stripes 68 of relatively high web density separated by stripes 69 of relatively low web density. The presence of the stripes 68, 69 results in an isotropic cross-machine to machine direction (MD/CD) strength ratio, considered to be isotropic for MD/CD strength ratios in the range of about 2:1 to 10:1. Generally, the striping occurs for an ACD that is less than twice the vertical dimension or length of the guides 60, 62 and increases with decreasing ACD. Compared with conventional guiding schemes, the action of the guides 60, 62 prevents the occurrence of random localized areas of relatively low web density and areas of relatively high web density in the nonwoven web. If striping is not desired, the ACD distance is selected such that filaments 24 guided by adjacent guides 60, 62 are more overlapping in the cross-machine direction, which produces isotropic MD/CD strength ratios of 1:1 to about 2:1. Generally, the ACD should be increased as the cross-machine dimension or transverse width of the guides 60, 62 is increased to prevent the occurrence of stripes of material having filament loops 48*b*.

Figure 6:
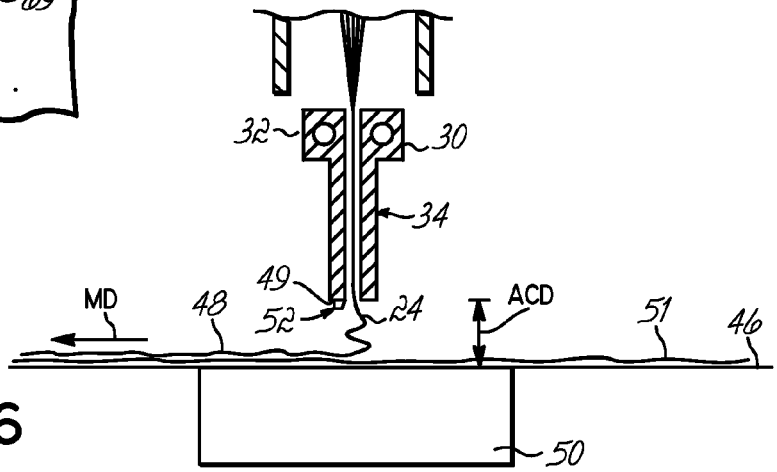
FIG. 6 is a side view in partial cross-section of a meltspinning apparatus in accordance with an alternative embodiment of the invention.

With reference to FIG. 6 in which like reference numerals refer to like features in FIGS. 1–4 and in accordance with an alternative embodiment of the invention, the body 54 of stabilizer 52 may be mounted to a lower surface 49 of the downstream manifold 32. To that end, body 54 is oriented such that the guides 60, 62 face toward outlet 44 of the filament drawing device 34.

Figure 7:
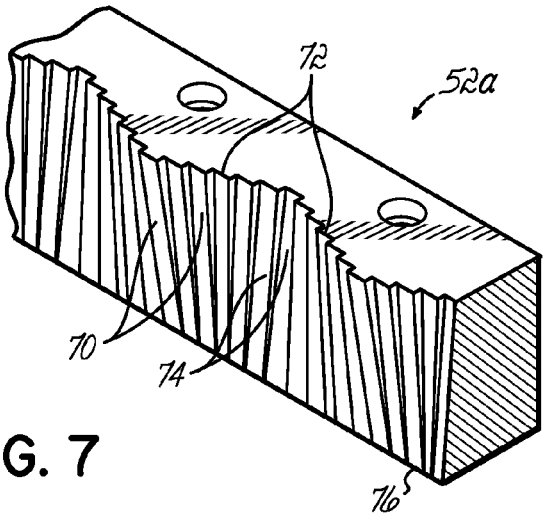
FIG. 7 is a partial bottom perspective view of an alternative embodiment of a drawing device in accordance with the principles of the invention, which is shown inverted for clarity.
Figure 8:
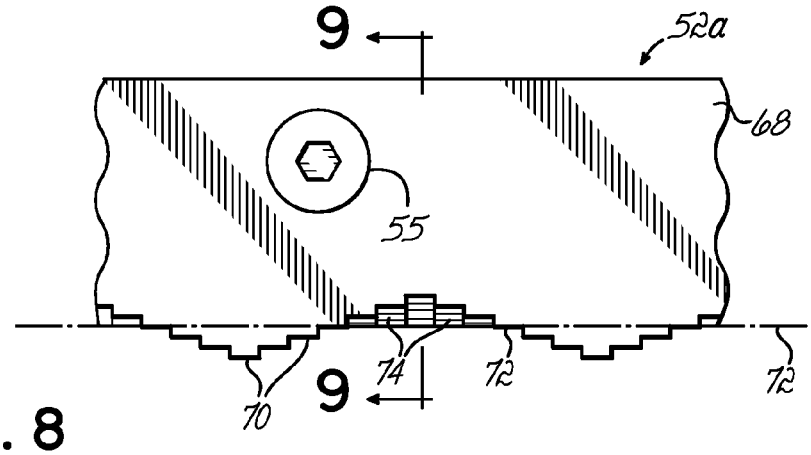
FIG. 8 is a bottom view of the drawing device of FIG. 7.
Figure 9:
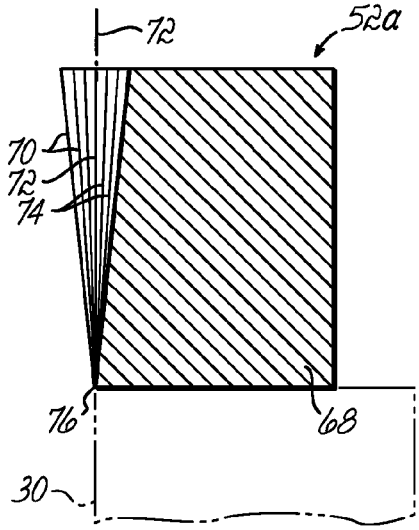
FIG. 9 is a cross-sectional view taken generally along line 9—9 in FIG. 8.

With reference to FIGS. 7–9 and in accordance with an alternative embodiment of the invention, a stabilizer 52*a* of drawing device 34 (FIG. 2) includes an elongated body 68 and a plurality of guides, generally indicated by reference numerals 70, 72 and 74, arranged with a systematic patterned relationship that repeats across the width of the body 68 in the cross-machine direction. Specifically, the guides 70 and 74 are systematically angled at equal angular increments between a positive maximum angle and a negative maximum angle symmetrical about a vertical plane 72 containing guides 72 and diverge from an edge 76. The declination angle of the individual guides 70 varies progressively from the maximum positive angle to vertical and, similarly, the declination angle of the individual guides 74 varies progressively from the maximum negative angle to vertical. Guides 70 are angles in a downstream direction, guides 72 are vertical, and guides 74 are angled in an upwnstream direction. In an exemplary embodiment, the declination angle of the guides 70 varies from +3° to a maximum of +9° to +3° in 3° increments and the declination of guides 74 varies from −3° to a maximum of −9° to −3° in 3° increments. This arrangement of guides 70, 72, 74 may cause nonwoven web 48 to have stripes of alternating MD:CD ratio in the cross-machine direction.

Figure 10:
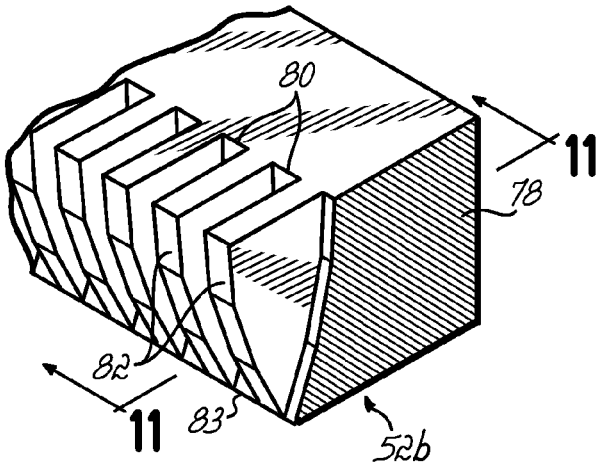
FIG. 10 is a partial perspective view of an alternative embodiment of a drawing device in accordance with the principles of the invention, which is shown inverted for clarity.
Figure 11:
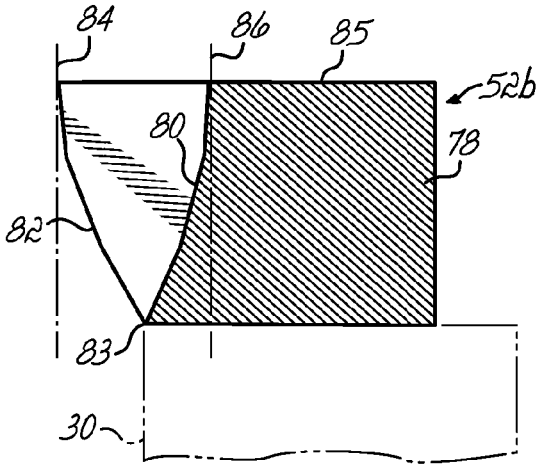
FIG. 11 is a cross-sectional view taken generally along line 11—11 of FIG. 10.
Figure 12:
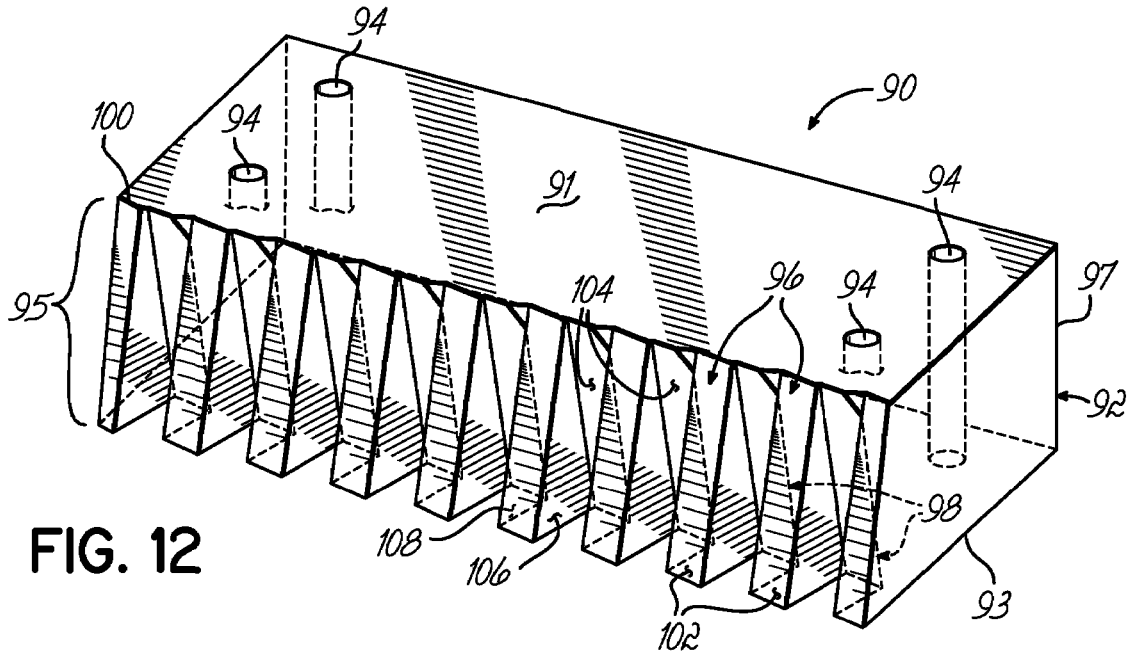
FIG. 12 is a partial perspective view of a stabilizer in accordance with an alternative embodiment of the present invention and for use with the meltspinning apparatus of FIGS. 1 and 2.

With reference to FIGS. 10 and 11 and in accordance with an alternative embodiment of the invention, a stabilizer 52*b* includes an elongated body 78, a plurality of first guides 80, and a plurality of second guides 82 separating adjacent guides 80. Guides 80 alternate with guides 82 in the cross-machine direction with a repeating patterned relationship across the width of the elongated body 78 and diverge from an edge 83. Each of the first guides 80 includes multiple facets having corresponding declination angles, relative to a vertical plane 84, that increase in uniform increments between a top surface 85 of the stabilizer 52*b* and the edge 83. Each of the second guides 82 includes multiple facets having corresponding individual declination angles, relative to a vertical plane 86, that likewise increase in uniform increments between the top surface 85 and the edge 83. Typically, the declination angle of the angled facets on guides 80, 82 varies monotonically in equal angular increments. In alternative embodiments of the invention, the declination angle of the individual facets on guides 80, 82 may vary in a different manner.

With reference to FIGS. 12–16 and in accordance with an alternative embodiment of the present invention, a stabilizer 90 includes at least one elongated body 92, which is similar to elongated body 54 (FIGS. 1–3), that includes bolt holes 94, which are similar to bolt holes 57 (FIGS. 1–3), for mounting the stabilizer 90 to the filament drawing device 34 (FIGS. 1–3). The stabilizer 90 may be constituted by a single elongated body 92 of sufficient length to substantially span the outlet 44 of slot 28 of the filament drawing device 34 (FIGS. 1 and 2). Alternatively, the stabilizer 90 may be constituted by a plurality of elongated bodies 92 that are arranged with adjacent ends in an abutting relationship or juxtaposed to provide a construction of sufficient length.

The body 92 includes a downstream side 95 adjacent to the outlet 44 of slot 28 of the filament drawing device 34 (FIGS. 1 and 2), an upstream side 97, an upper side 91 that is proximate to the filament drawing device 34, and a lower side 93. The downstream and upstream sides 95, 97 are connected by the upper and lower sides 91, 93. The downstream direction is generally co-linear with the machine direction and the upstream direction is oriented antiparallel with the machine direction.

The downstream side 95 of the body 92 includes a plurality of first guides 96 that project in the downstream direction. A plurality of second guides 98 alternate, or are interleaved, with guides 96 in the cross-machine direction and project in the upstream direction. Guides 96, 98, which are similar in construction and operation to guides 60, 62 (FIGS. 2–4), diverge in alternating downstream and upstream directions from an edge 100 extending parallel to the cross-machine direction (CD). The guides 96, 98 interrupt the smoothness or planarity of side 95 to cause the flow of air discharged from filament drawing device 34 and the filaments 24 (FIG. 1) to deviate from the discharge direction, which is generally perpendicular to the machine and cross-machine directions. The upstream side 97 of body 92, which is remote from the filaments 24, lacks any structure for filament guiding.

Each of the guides 96 has an inclined surface 102 angled with a negative inclination angle $\alpha$ measured relative to a downward direction representing a discharge direction 105 for the filaments 24. Inclined surface 102 constitutes the majority of the surface area of guide 96. Plane 105 is positioned with a bisecting relationship between adjacent pairs of first and second guides 96, 98. Similarly, each of the guides 98 has an inclined surface 104 angled with a positive inclination angle $\beta$ relative to the discharge direction 105. The discharge direction 105 is substantially perpendicular to the cross-machine direction (i.e., CD). Inclined surface 104 constitutes the majority of the surface area of guide 98. Typically, the inclination angles of the surfaces 102, 104 are equal and opposite relative to the discharge direction 105, although the invention is not so limited. The inclination angles of surfaces 102, 104 may also be viewed from a different perspective as declination angles.

Each guide 96 is flanked along its side edges by a pair of guides 98. One side edge of the inclined surface 102 of each guide 96 is connected to the inclined surface 104 of an adjacent one of the guides 98 by side surface 106. The other side edge of the inclined surface 102 of each guide 96 is connected to the inclined surface 104 of another adjacent one of the guides 98 by a side surface 108. The side surfaces 106, 108 intersect the corresponding inclined surface 102, 104, respectively, at a right angle corner and are mutually parallel. The inclined surfaces 102, 104 are inclined with different inclination angles relative to a common plane that contains the discharge direction and the cross-machine direction along which the outlet 44 of slot 28 (FIGS. 1 and 2) extends. The inclined surfaces 102, 104 cause the flow of air and the filaments to deviate from the discharge direction.

Figure 13:
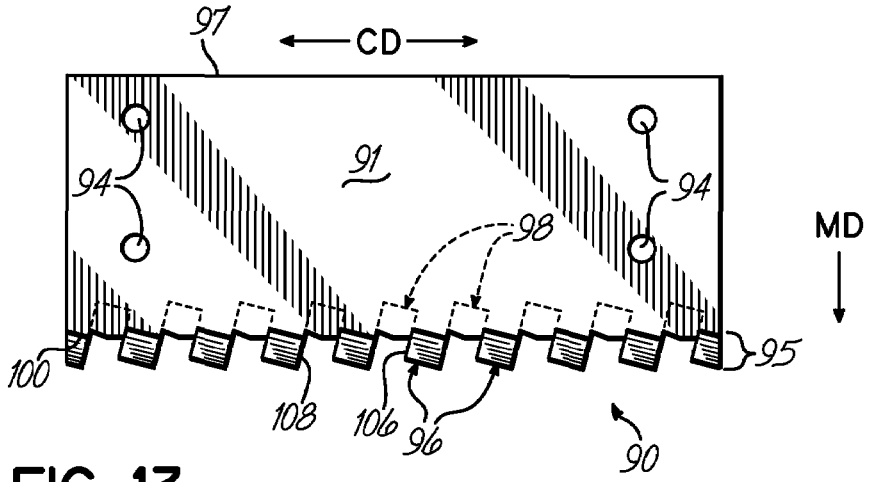
FIG. 13 is a top view of the stabilizer of FIG. 12.
Figure 13A:
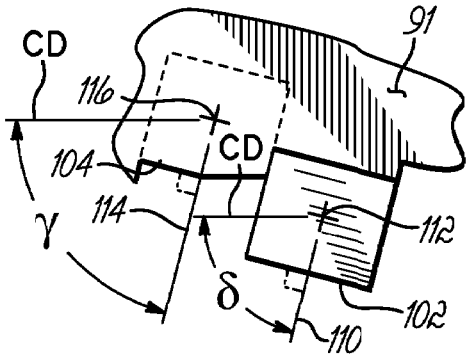
FIG. 13A is an enlarged view of a portion of FIG. 13.
Figure 14:
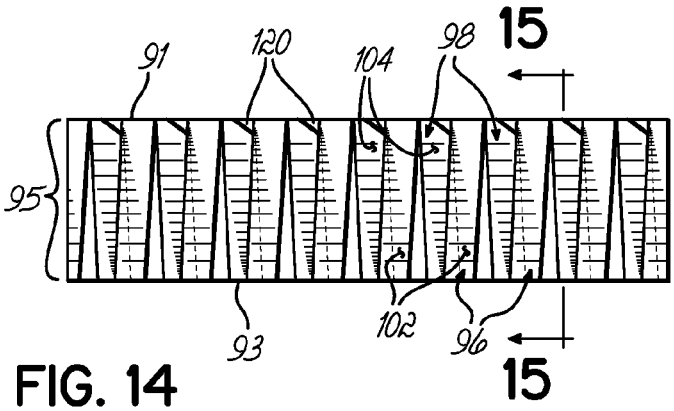
FIG. 14 is a front view of the stabilizer of FIG. 12.
Figure 15:
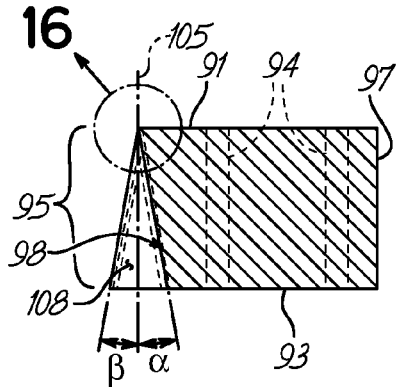
FIG. 15 is a cross-sectional view taken generally along line 15—15 of FIG. 14.
Figure 16:
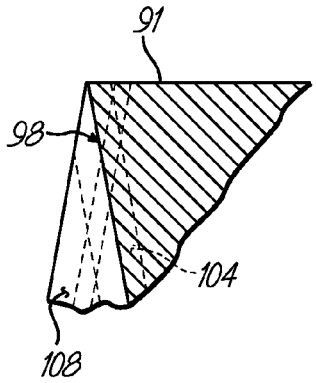
FIG. 16 is an enlarged view of a portion of FIG. 15.

As best shown in FIG. 13A, a surface normal 110 of inclined surface 102 is rotated about an axis 112 aligned parallel to the discharge direction 105 by an angle $\delta$, which is measured relative to the cross-machine direction (CD). Equivalently, the surface normal 110 of inclined surface 102 is rotated about axis 112 by an angle of $(90°-\delta)$ relative to the machine direction (MD).

Similarly and as best shown in FIG. 13A, a surface normal 114 of inclined surface 104 is rotated about an axis 116 aligned parallel to the discharge direction 105 by a rotational angle $\gamma$, which is measured relative to the cross-machine direction (CD). Equivalently, the surface normal 114 of inclined surface 104 is rotated about axis 116 by a rotational angle of $(90°-\gamma)$ relative to the machine direction (MD).

In an exemplary embodiment of the present invention, the angles $\delta$ and $\gamma$ may each be approximately +75° relative to the cross-machine direction. Consequently, the plane of inclined surface 102 and the plane of inclined surfaces 104 are not co-planar with a plane containing the cross-machine direction, as is the case for the major inclined surfaces of guides 60, 62 (FIGS. 2–4).

The rotation of the inclined surfaces 102, 104 of guides 96, 98, respectively, relative to the cross-machine direction is believed to enhance entanglement of the deposited filaments 24 in nonwoven web 48 (FIG. 1). In particular, rotation of the inclined surfaces 102, 104 relative to the cross-machine direction is believed to provide a larger component for the velocity of the discharged air in the cross-machine direction and faster dissipation of air velocity. These influences on the moving filaments 24 are believed to reduce striping of the nonwoven web 48 in the machine direction. The enhanced dissipation of air velocity reduces the air velocity at the collector 46, which reduces the vacuum requirements for air management system 50.

A plurality of facets 120 are defined in side 95 of body 92 near the edge 100. The facets 120 operate to reduce the apparent irregularity of edge 100 resulting from the rotation of the guides 96, 98 such that the edge 100 is effectively straighter or more linear than in the absence of facets 120. This reduces the influence of the irregularity of edge 100 upon the guiding of the filaments 24 and associated discharged air from filament drawing device 34 by guides 96, 98. The facets 120 lessen sharp corners or edges near the outlet 44 that the filaments 24 might otherwise contact. The facets 120 may generate vortices that further enhance entanglement of the filaments 24 in nonwoven web 48.

The invention contemplates that a series of spunbonding apparatus, each similar to spunbonding apparatus 10, may each include a stabilizer, each similar to stabilizer 90. In this situation, the guides 96, 98 of each of the stabilizers 90 may be rotated relative to the cross-machine direction with different angles $\alpha$ and $\beta$. For example, the guides 96, 98 of the first spunbonding apparatus 10 supplying a first beam may have a clockwise rotation relative to the machine direction and the guides 96, 98 of the second spunbonding apparatus 10 supplying a second beam may have a counterclockwise rotation relative to the machine direction.

While the present invention has been illustrated by a description of various embodiments and while these embodiments have been described in considerable detail, it is not the intention of the applicant to restrict or in any way limit the scope of the appended claims to such detail. Additional advantages and modifications will readily appear to those skilled in the art. The invention in its broader aspects is therefore not limited to the specific details, representative apparatus and methods, and illustrative examples shown and described. Accordingly, departures may be made from such details without departing from the spirit or scope of applicant's general inventive concept.

We claim:

1. A drawing device for attenuating a plurality of filaments in a meltspinning apparatus, the drawing device comprising:

a manifold including an inlet for receiving the filaments, an outlet oriented in a cross-machine direction, and a passageway between said inlet and said outlet, said manifold having a slotted channel communicating with said passageway for discharging air to impinge the filaments in said passageway and said manifold discharging the filaments and the air from said outlet in a downward direction perpendicular to said cross-machine direction;

a plurality of first guides positioned proximate to said outlet, each of said first guides including a first major surface oriented at a first rotational angle relative to said cross-machine direction; and a plurality of second guides positioned proximate to said outlet, each of said second guides positioned between a corresponding adjacent pair of said first guides, each of said second guides including a second major surface oriented at a second rotational angle relative to said to said cross-machine direction, wherein said first and second major surfaces are inclined with different inclination angles relative to said downward direction so as to cause the flow of air and the filaments to deviate from said downward direction.

2. The drawing device of claim 1 wherein said first rotational angle is equal to said second rotational angle.

3. The drawing device of claim 2 wherein said first and second rotational angles are approximately 75°.

4. The drawing device of claim 1 further comprising:

a body carrying said first and second guides and having a side proximate to said outlet, said first and second guides being integral with said side of said body.

5. The drawing device of claim 4 wherein said body includes an edge adjoining said side, said first and second guides diverging in said downward direction from said edge, and said first and second guides each including a facet proximate to said edge.

6. A meltspinning apparatus for depositing filaments on a collector to form a nonwoven web, comprising:

a spin pack capable of forming filaments from a thermoplastic material;

a drawing device including an inlet for receiving the filaments from said spin pack, an outlet oriented in a cross-machine direction, and a passageway extending from said inlet to said outlet, said drawing device having a slotted channel communicating with said passageway for discharging air to impinge the filaments in said passageway, and said drawing device discharging the filaments and the flow of air from said outlet in a downward direction perpendicular to said cross-machine direction;

a plurality of first guides positioned proximate to said outlet, each of said first guides including a first major surface oriented at a first rotational angle relative to said cross-machine direction; and a plurality of second guides each positioned between a corresponding adjacent pair of first guides, each of said second guides including a second major surface oriented at a second rotational angle relative to said cross-machine direction, wherein said first and second major surfaces are inclined with different inclination angles relative to said downward direction so as to cause the flow of air and the filaments to deviate from said downward direction.

7. The meltspinning apparatus of claim 6 wherein said first rotational angle is equal to said second rotational angle.

8. The meltspinning apparatus of claim 7 wherein said first and second rotational angles are approximately 75°.

9. The meltspinning apparatus of claim 6 further comprising:

a body carrying said first and second guides and having a side proximate to said outlet, said first and second guides being integral with said side of said body.

10. The meltspinning apparatus of claim 9 wherein said body includes an edge adjoining said side, said first and second guides diverging in said downward direction from said edge, and said first and second guides each including a facet proximate to said edge.

* * * * *